US006298987B1

(12) United States Patent
Clark

(10) Patent No.: US 6,298,987 B1
(45) Date of Patent: Oct. 9, 2001

(54) GOLF CLUB PROTECTION SYSTEM

(76) Inventor: Steven Clark, 37 Ewellhurst Road, Ilford, Essex IG5 OPD (GB)

( * ) Notice: Subject to any disclaimer, the term of this patent is extended or adjusted under 35 U.S.C. 154(b) by 0 days.

(21) Appl. No.: 09/607,345

(22) Filed: Jun. 30, 2000

(51) Int. Cl.[7] ..... A63B 55/00

(52) U.S. Cl. ..... 206/315.6; 206/315.2; 206/315.4

(58) Field of Search ..... 206/315.2, 315.3, 206/315.4, 315.6

(56) References Cited

U.S. PATENT DOCUMENTS

| | | | | |
|---|---|---|---|---|
| D. 256,293 | | 8/1980 | Edwards . | |
| 2,128,546 | * | 8/1938 | Venmore | 206/315.2 |
| 2,879,819 | | 3/1959 | Turnbull . | |
| 3,554,255 | * | 1/1971 | Mangan | 206/315.6 |
| 3,980,115 | * | 9/1976 | Longo | 206/315.6 |
| 4,938,349 | * | 7/1990 | Burns | 206/315.6 |
| 5,000,238 | | 3/1991 | Zeller . | |
| 5,437,320 | | 8/1995 | Sung . | |
| 5,458,240 | * | 10/1995 | Rich et al. | 206/315.6 X |
| 5,779,042 | | 7/1998 | Kaneko . | |
| 5,819,829 | | 10/1998 | Matthews . | |

* cited by examiner

*Primary Examiner*—Gene Mancene
*Assistant Examiner*—Tri M. Mai

(57) ABSTRACT

A golf club protection system for protecting golf clubs from the elements. The golf club protection system includes a plurality of tubes for insertion into a golf bag. Each of the tubes has a first end and a second end. Each of the tubes is generally hollow. A plurality of head covers the heads of golf clubs. Each of the head covers comprising a housing. The housing has a leg portion and a foot portion. The housing is generally hollow. The leg portion has a free end having an opening therein adapted for removably coupling to the second end of one of the tubes. The foot portion has an open bottom side. A covering means covers the opening in the foot portion. The covering means has a shape adapted to cover the opening. The covering means is selectively movable between an open and a closed position.

13 Claims, 2 Drawing Sheets

GOLF CLUB PROTECTION SYSTEM

BACKGROUND OF THE INVENTION

1. Field of the Invention

The present invention relates to gold club protectors and more particularly pertains to a new golf club protection system for protecting golf clubs from the elements.

2. Description of the Prior Art

The use of gold club protectors is known in the prior art. More specifically, gold club protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,437,320; 5,779,042; 5,000,238; 2,879,819; 5,819,829; and U.S. Des. Pat. No. 256,293.

While these devices fulfill their respective, particular objectives and requirements, the aforementioned patents do not disclose a new golf club protection system. The inventive device includes a plurality of tubes for insertion into a golf bag. Each of the tubes has a first end and a second end. Each of the tubes is generally hollow. A plurality of head covers the heads of golf clubs. Each of the head covers comprising a housing. The housing has a leg portion and a foot portion. The housing is generally hollow. The leg portion has a free end having an opening therein adapted for removably coupling to the second end of one of the tubes. The foot portion has an open bottom side. A covering means covers the opening in the foot portion. The covering means has a shape adapted to cover the opening. The covering means is selectively movable between an open and a closed position.

In these respects, the golf club protection system according to the present invention substantially departs from the conventional concepts and designs of the prior art, and in so doing provides an apparatus primarily developed for the purpose of protecting golf clubs from the elements.

SUMMARY OF THE INVENTION

In view of the foregoing disadvantages inherent in the known types of gold club protectors now present in the prior art, the present invention provides a new golf club protection system construction wherein the same can be utilized for protecting golf clubs from the elements.

The general purpose of the present invention, which will be described subsequently in greater detail, is to provide a new golf club protection system apparatus and method which has many of the advantages of the gold club protectors mentioned heretofore and many novel features that result in a new golf club protection system which is not anticipated, rendered obvious, suggested, or even implied by any of the prior art gold club protectors, either alone or in any combination thereof.

To attain this, the present invention generally comprises a plurality of tubes for insertion into a golf bag. Each of the tubes has a first end and a second end. Each of the tubes is generally hollow. A plurality of head covers the heads of golf clubs. Each of the head covers comprising a housing. The housing has a leg portion and a foot portion. The housing is generally hollow. The leg portion has a free end having an opening therein adapted for removably coupling to the second end of one of the tubes. The foot portion has an open bottom side. A covering means covers the opening in the foot portion. The covering means has a shape adapted to cover the opening. The covering means is selectively movable between an open and a closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf club protection system apparatus and method which has many of the advantages of the gold club protectors mentioned heretofore and many novel features that result in a new golf club protection system which is not anticipated, rendered obvious, suggested, or even implied by any of the prior art gold club protectors, either alone or in any combination thereof.

It is another object of the present invention to provide a new golf club protection system which may be easily and efficiently manufactured and marketed.

It is a further object of the present invention to provide a new golf club protection system which is of a durable and reliable construction.

An even further object of the present invention is to provide a new golf club protection system which is susceptible of a low cost of manufacture with regard to both materials and labor, and which accordingly is then susceptible of low prices of sale to the consuming public, thereby making such golf club protection system economically available to the buying public.

Still yet another object of the present invention is to provide a new golf club protection system which provides in the apparatuses and methods of the prior art some of the advantages thereof, while simultaneously overcoming some of the disadvantages normally associated therewith.

Still another object of the present invention is to provide a new golf club protection system for protecting golf clubs from the elements.

Yet another object of the present invention is to provide a new golf club protection system which includes a plurality of tubes for insertion into a golf bag. Each of the tubes has a first end and a second end. Each of the tubes is generally hollow. A plurality of head covers the heads of golf clubs. Each of the head covers comprising a housing. The housing has a leg portion and a foot portion. The housing is generally hollow. The leg portion has a free end having an opening therein adapted for removably coupling to the second end of one of the tubes. The foot portion has an open bottom side. A covering means covers the opening in the foot portion. The covering means has a shape adapted to cover the opening. The covering means is selectively movable between an open and a closed position.

Still yet another object of the present invention is to provide a new golf club protection system that keeps golf clubs dry by shielding them from water and other moisture.

Even still another object of the present invention is to provide a new golf club protection system that prevents rain from entering the golf bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
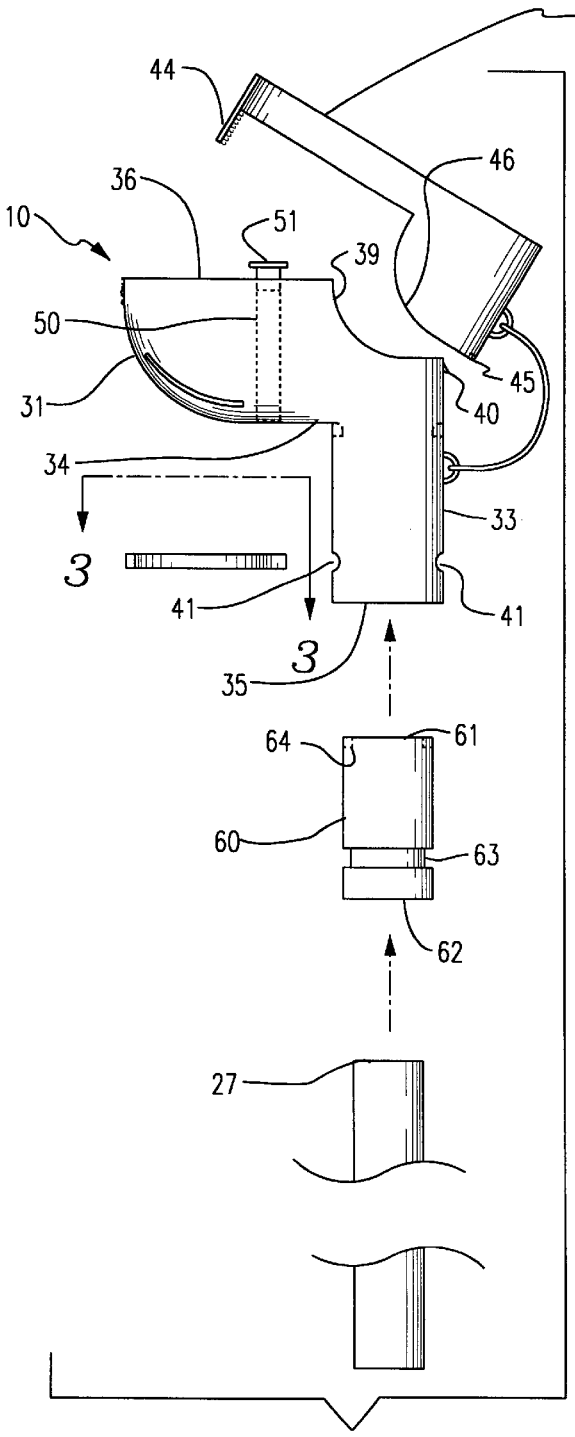
FIG. 1 is a schematic side view of a new golf club protection system according to the present invention.

With reference now to the drawings, and in particular to FIGS. 1 through 5 thereof, a new golf club protection system embodying the principles and concepts of the present invention and generally designated by the reference numeral 10 will be described.

As best illustrated in FIGS. 1 through 5. The golf club protection system 10 generally comprises a system which is mountable to a golf bag 12. The golf bag 12 has a bottom wall 13. A peripheral wall 14 is coupled to and extends away from the bottom wall 13. The peripheral wall 14 has a top edge 15. The golf bag 12 has an opening therein, which is bounded by the top edge 15 of the peripheral wall 14. The peripheral wall 14 has a strap 16 coupled thereto such that the strap 16 may be used as a handle to carry the golf bag 12. A spacing wall 17 spaces the clubs mounted in the bag 12. The spacing wall 17 is generally parallel to and spaced from the bottom wall 13. The spacing wall 17 has bores therein.

A covering member 20 covers the opening of the golf bag 12. The covering member 20 comprises a plate 21. The plate 21 has a peripheral edge 22, which has a peripheral lip 23 coupled thereto. The covering member 20 has a shape adapted to fit over the opening of the golf bag 12. The peripheral lip 23 may be fixedly coupled to an exterior surface of the peripheral wall 14 of the golf bag 12 such that the peripheral edge 22 of the plate 21 is located generally adjacent to the free edge 15 of the golf bag 12. The plate 21 preferably has a generally circular shape.

A plurality of bores 24 are located in the plate 21. Preferably there are twelve to sixteen bores. Ideally there are fourteen bores.

Each of a plurality of cuffs 25 is fixedly coupled to one of the bores 25 in the plate. Each of the cuffs 25 extends upwardly away from the plate 20. Each of the cuffs 25 ideally comprises an elastomeric material such as natural or synthetic rubber.

A plurality of tubes 26 each has a first end 27, a second end 28 and a middle portion 29. Each of the tubes 26 is generally hollow. Each of the first ends 27 of the tubes is removably insertable through one of the bores in the spacing wall 17. The second ends 28 of the tubes 26 are removably insertable through one of the bores 24 in the plate 21 such that the cuffs 25 form a water resistant seal around the tubes 26. Ideally, each of the tubes 26 is resiliently flexible. The portions of the tubes between the cuffs 25 and the first ends 27 may either being resiliently flexible or substantially rigid. If those portions are resiliently flexible, then dowel shaped spacers may be dropped into the tubes. Being flexible allows them to be compressed so that the golf club may be easily gripped and removed from the tube. The spacers will rest against the bottom of the bag and will hold the club up a specified height. If the portions are rigid, then no spacers are needed as the portions themselves will hold the club upwards.

A plurality of head covers 30 cover the heads of the golf clubs. Each of the head covers 30 includes a housing 31 and a covering 32 means for the housing 31.

The housing 31 has a leg portion 33 and a foot portion 34. The housing 31 is generally hollow. The leg portion 33 has a free end 35 having an opening therein. The foot portion 34 has a shape adapted for holding the head of a golf club. The foot portion 34 has an open bottom side 36. The foot portion 34 has a distal end 37 and a proximal end 38. The distal end 37 is generally adjacent to the leg portion 33. The distal end 37 has a concave edge 39 cut therein. A flange 40 is located on the exterior surface of the distal end 37 of the foot portion 34. The leg portion 33 has a pair of opposed apertures 41 therein, which are located generally adjacent to the free end 35 of the leg portion 33.

The covering means 32 covers the opening and the concave edge 39 in the foot portion 34. The covering means 32 is selectively movable between an open, shown in FIG. 1, and a closed, shown in FIG. 2, position. The covering means 32 has a distal portion 42 and proximal portion 43. The covering means 32 has a shape adapted to cover the opening. A tab 44 is coupled to proximal portion 43. The tab 44 is removably fastened to the proximal end 38 of the foot portion 34 using a hook and loop fastening means. The distal portion 42 has an inside surface having a niche 45 therein for receiving the flange 40 on the foot portion 34. The distal portion 42 has a convex edge 46 such that the convex edge 46 of the covering means 32 may cover the concave edge 39 of the foot portion 34.

A tethering means 47 tethers the covering means 32 to the foot portion 34. The tethering means 32 is elongate and has a first 48 and second end 49. The first end 48 is fixedly coupled to the distal end 37 of the foot portion 34 and the second end 49 is fixedly coupled to the distal portion 42 of the covering means 32. The tethering means 47 is an elastic cord.

A lifting means 50 lifts the head of the golf club away from the foot portion 34. The lifting means 50 is an elongate flexible member having a first end, not shown, and a second end 51. The first end is fixedly coupled to an edge of the bottom side 36 of the foot portion 34 such that the elongate flexible member extends across the foot portion along a line orientated generally perpendicular to a line extending between the distal 37 and proximal 38 ends of the foot portion 34. The second end 51 is lifted to pull the club head upward.

A coupling means 60 removably couples each of the head covers 30 to one of the first ends 28 of the tubes 26. Each of coupling means 60 is generally tubular shaped. Each of the coupling means 60 is generally hollow and has a first 61 and second 62 open end. An annular groove 63 extends about the coupling means 60. The annular groove 63 is generally located adjacent to the second end 62. A pair of protruding members 64 is fixedly coupled to an inner wall of the coupling means 60 to be biased against the first end 27 of the tube 26. The protruding members 64 are generally located adjacent to the first end 61 of the coupling means 60. The coupling means 60 has an inner circumference substantially equal to an outer circumference of the tubes 26. The coupling means 60 has an outer circumference substantially equal to an inner circumference of the leg portion 33 such that each of the tubes 26 may be inserted in one of the coupling means 60 and each of the coupling means 60 may be inserted into one of the leg portions 33.

A fastening means 65 removably fastens the coupling means 60 to the leg portion 33. The fastening means 65 is an annular member having a break therein 66, wherein each of the ends form feet 67 extending away from the fastening means 65. The annular member 66 is resiliently flexible such that the annular member may be placed about the leg portion 33 such that a portion of the annular member is positioned in each of the slots 41 of the leg member 33 and in the annular groove 63 of the coupling means 60.

A second embodiment, not shown, would fixedly couple the head cover 30 to tube 26 such that it is only one piece. The advantage of the first embodiment is its ability to change the head cover 30 in order to place different head cover sizes on the tubes.

Figure 2:
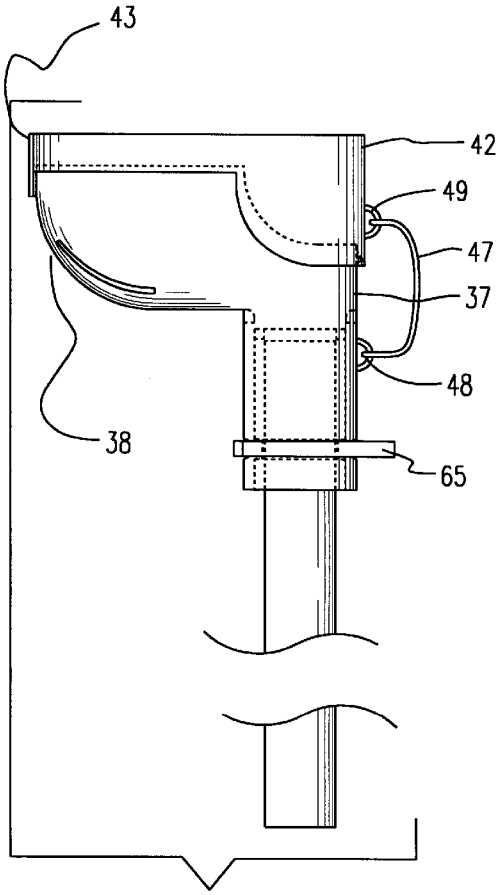
FIG. 2 is a schematic side view of the present invention.
Figure 3:
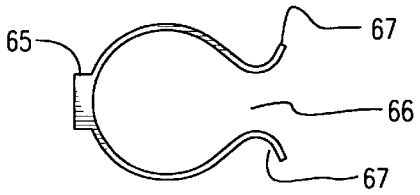
FIG. 3 is a schematic top view of the fastening means of the present invention.
Figure 4:
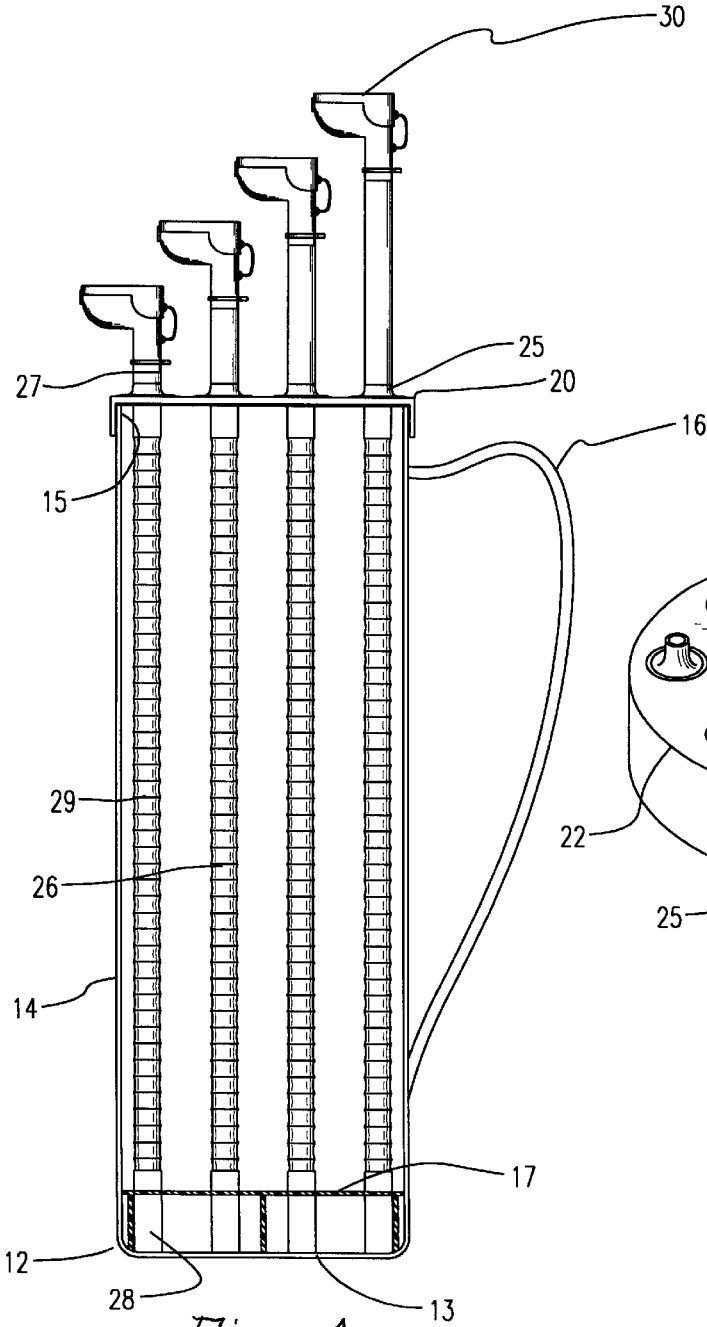
FIG. 4 is a schematic side view of the present invention.
Figure 5:
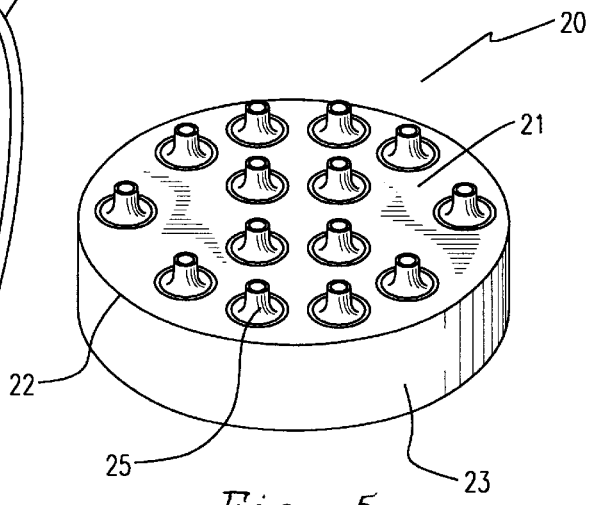
FIG. 5 is a schematic perspective view of the covering member of the present invention.

In use, the user places the coupling means 60 on the first end 27 of the tube 26 and the coupling means 60 in the leg portion 33 as depicted in FIGS. 1 and 2. The fastening means 65 is then placed over the leg portion 33 so that the edges of the fastening means 60 slide into the apertures 41 in the leg portion so that the annular ridge 63 is held in place. The user then places the golf club shaft into the tube so that the head of the golf club rests in the foot portion 34 of the club cover. The lifting means 50 assists the golfer in removing the club. The head of the club rests on the lifting means 50 and when the lifting means is lifted, the head of the club is lifted with it for easy grasping. The convex curve 39 in the foot portion 34 also allows the user to grab the heel of the golf club.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf club protecting system for protecting the heads and shafts of a set of golf clubs, the system being mountable to a golf bag, the golf bag having a bottom wall, a peripheral wall being coupled to and extending away from said bottom wall, the peripheral wall having a top edge, said golf bag having an opening bounded by the top edge, said system comprising:

a plurality of tubes, each of said tubes having a first end, and a second end, each of said tubes being generally hollow;

a plurality of head covers for covering the heads of the golf clubs, each of said head covers comprising:

a housing, said housing having a leg portion and a foot portion, said housing being generally hollow, said leg portion has a free end having an opening therein adapted for removably coupling to the second end of one of said tubes, said foot portion having an open bottom side; and a covering means for covering said opening in said foot portion, said covering means having a shape adapted to cover said opening, said covering means being selectively niovable between an open and a closed a covering member for covering the opening of the golf bag, said covering member comprising a plate, said plate being fixedly coupled to the top edge of the golf bag, said plate having a plurality of bores therein, wherein each of said tubes may be slidably inserted in one of said bores in said covering member;

a plurality of cuffs, each of said cuffs being fixedly coupled to one of said bores in said plate, each of said cuffs extending upwardly away from said plate, each of said second ends of said tubes being removably insertable through one of said cuffs such that said cuffs comprise a water resistant seal around said tubes.

2. The golf club protecting system as in claim 1, each of said head covers further comprising:

a lifting means for lifting the head of the golf club away from said foot portion, said lifting means being an elongate flexible member having a first end and a second end, said first end being fixedly coupled to an edge of said bottom side of said foot portion such that said elongate flexible member extends across said foot portion along a line orientated generally perpendicular to a line extending between distal and proximal ends of said foot portion, wherein said second end is lifted to pull the club head upward.

3. The golf club protecting system as in claim 1, wherein each of said head covers further comprises:

a tethering means for tethering said coveing means to said foot portion, said tethering means being elongate and having a first and second end, said first end being fixedly coupled to a distal end of said foot portion and said second end being fixedly coupled to a distal portion of said covering means, said tethering means being flexible.

4. The golf club protecting system as in claim 1, wherein each of said tubes is resiliently flexible.

5. The golf club protecting system as in claim 1, wherein each of said head covers further comprises:

said foot portion of said housing having a distal end and a proximal end, said distal end being generally adjacent to said leg portion, said distal end generally comprising a concave edge, a flange being on said exterior surface of said distal end of said foot portion; and said covering means having a distal portion and proximal portion, said covering means having a shape adapted to cover said opening and said concave edge, a tab being coupled to proximal portion, said tab being removably fastened to said proximal end of said foot portion, said distal portion having an inside surface having a niche therein for receiving said flange on said foot portion, said distal portion having a convex edge such that said convex edge of said covering means may cover said concave edge of said foot portion.

6. The golf club protecting system as in claim 5, each of said head covers further comprising:

said leg portion having a pair of opposed apertures therein, said apertures being located generally adjacent to said free end of said leg portion; and a coupling means for removably coupling each of said head covers to one of said first ends of said tubes, each of coupling means being generally tubular shaped, each of said coupling means being generally hollow and having a first and second open end, an annular groove extending about said coupling means, said annular groove being generally located adjacent to said second end, said coupling means having an inner circumference being substantially equal to an outer circumference of said tubes, said coupling means having an outer circumference being substantially equal to an inner circumference of said leg portion; and a fastening means for removably fastening said coupling means to said leg portion, said fastening means being an annular member having a break therein, said annular member being resiliently flexible such that said annular member may be placed about said leg portion such that a portion of said annular member is positioned in each of said slots of said leg member and in said annular groove of said coupling means.

7. A golf club protecting system for protecting the heads and shafts of a set of golf clubs, said system comprising:

a golf bag, said golf bag having a bottom wall, a peripheral wall being coupled to and extending away from said bottom wall, said peripheral wall having a top edge, said golf bag having an opening therein, said opening being bounded by said top edge of said peripheral wall, said peripheral wall having a strap coupled thereto such that said strap may be used as a handle to carry said golf bag, a spacing wall for spacing the clubs being mounted in the bag, said spacing wall being generally parallel to and spaced from said bottom wall, said spacing wall having bores therein;

a covering member for covering said opening of said golf bag, said covering member comprising a plate, said plate having a peripheral edge, said peripheral edge having a peripheral lip coupled thereto, said covering member having a shape adapted to fit over said opening of said golf bag such that said peripheral lip may be fixedly coupled to an exterior surface of said peripheral wall of said golf bag such that said peripheral edge of said plate is located generally adjacent to said free edge of said golf bag, said plate having a generally circular shape;

a plurality of bores in said plate;

a plurality of cuffs, each of said cuffs being fixedly coupled to one of said bores in said plate, each of said cuffs extending upwardly away from said plate, each of said cuffs comprising an elastomeric material;

a plurality of tubes, each of said tubes having a first end, a second end and a middle portion, each of said tubes being generally hollow, each of said first ends of said tubes being removably insertable through one of said bores in said spacing wall, each of said second ends of said tubes being removably insertable through one of said bores plate such that said cuffs define a water resistant seal around said tubes, each of said tubes being resiliently flexible;

a plurality of head covers for covering the heads of the golf clubs, each of said head covers comprising:

a housing, said housing having a leg portion and a foot portion, said housing being generally hollow, said leg portion has a free end having an opening therein, said foot portion having a shape adapted for holding the head of a golf club, said foot portion having an open bottom side, said foot portion having a distal end and a proximal end, said distal end being generally adjacent to said leg portion, said distal end generally comprising a concave edge, a flange being on said exterior surface of said distal end of said foot portion, said leg portion having a pair of opposed apertures therein, said apertures being located generally adjacent to said free end of said leg portion;

a covering means for covering said opening and said concave edge in said foot portion, said covering means being selectively movable between an open and a closed position, wherein said closed position is defined as said covering means being placed over said opening in said foot portion, said covering means having a distal portion and proximal portion, said covering means having a shape adapted to cover said opening, a tab being coupled to proximal portion, said tab being removably fastened to said proximal end of said foot portion, said distal portion having an inside surface having a niche therein for receiving said flange on said foot portion, said distal portion having a convex edge such that said convex edge of said covering means may cover said concave edge of said foot portion;

a tethering means for tethering said covering means to said foot portion, said tethering means being elongate and having a first and second end, said first end being fixedly coupled to said distal end of said foot portion and said second end being fixedly coupled to said distal portion of said covering means, said tethering means being an elastic cord;

a lifting means for lifting the head of the golf club away from said foot portion, said lifting means being an elongate flexible member having a first end and a second end, said first end being fixedly coupled to an edge of said bottom side of said foot portion such that said elongate flexible member extends across said foot portion along a line orientated generally perpendicular to a line extending between said distal and proximal ends of said foot portion, wherein said second end is lifted to pull the club head upward;

a coupling means for removably coupling each of said head covers to one of said first ends of said tubes, each of coupling means being generally tubular shaped, each of said coupling means being generally hollow and having a first and second open end, an annular groove extending about said coupling means, said annular groove being generally located adjacent to said second end, a pair of protruding members being fixedly coupled to an inner wall of said coupling means, said protruding members being generally located adjacent to said first end of said coupling means, said coupling means having an inner circumference being substantially equal to an outer circumference of said tubes, said coupling means having an outer circumference being substantially equal to an inner circumference of said leg portion such that each of said tubes may be inserted in one of said coupling means and each of said coupling means may be inserted into one of said leg portions; and a fastening means for removably fastening said coupling means to said leg portion, said fastening means being an annular member having a break therein, said annular member is resiliently flexible such that said annular member may be placed about said leg portion such that a portion of said annular member is positioned in each of said slots of said leg member and in said annular groove of said coupling means.

8. A golf club protecting system for protecting heads and shafts of a set of golf clubs, said system comprising:

a plurality of tubes, each of said tubes having a first end and a second end, each of said tubes having an interior for receiving a portion of a golf club;

a plurality of head covers for covering the heads of the golf clubs, each of said head covers comprising:

a housing having a leg portion and a foot portion, said housing having an interior for receiving a portion of a golf club, said leg portion having a free end with an opening therein adapted for removably coupling to the second end of one of said tubes, said foot portion having an open bottom side; and a covering means for covering said opening in said foot portion, said covering means being selectively movable between an open and a closed position;

a covering member for covering a top opening of a golf bag, said covering member being mountable on a top edge of the golf bag, said covering member having a plurality of bores therein, wherein each of said tubes may be slidably inserted in one of said bores in said covering member;

a plurality of cuffs, each of said cuffs being mounted on one of said bores in said covering member, each of said cuffs extending upwardly away from said covering member, each of said second ends of said tubes being removably insertable through one of said cuffs such that said cuffs form a water resistant seal around said tubes.

9. The golf club protecting system as in claim 8, wherein each of said tubes is resiliently flexible.

10. The golf club protecting system as in claim 8, wherein each of said head covers further comprises:

said foot portion of said housing having a distal end and a proximal end, said distal end being generally adjacent to said leg portion, said distal end generally comprising a concave edge, a flange being on said exterior surface of said distal end of said foot portion; and said covering means having a distal portion and proximal portion, said covering means having a shape adapted to cover said opening and said concave edge, a tab being coupled to proximal portion, said tab being removably fastened to said proximal end of said foot portion, said distal portion having an inside surface having a niche therein for receiving said flange on said foot portion, said distal portion having a convex edge such that said convex edge of said coveting means may cover said concave edge of said foot portion.

11. The golf club protecting system as in claim 10, each of said head covers further comprising:

said leg portion having a pair of opposed apcrtures therein, said apertures being located generally adjacent to said free end of said leg portion; and a coupling means for removably coupling each of said head covers to one of said first ends of said tubes, each of coupling means being generally tubular shaped, each of said coupling means being generally hollow and having a first and second open end, an annular groove extending about said coupling means, said annular groove being generally located adjacent to said second end, said coupling means having an inner circumference being substantially equal to an outer circumference of said tubes, said coupling means having an outer circumference being substantially equal to an inner circumference of said leg portion; and a fastening means for removably fastening said coupling means to said leg portion, said fastening means being an annular member having a break therein, said annular member being resiliently flexible such that said annular member may be placed about said leg portion such that a portion of said annular member is positioned in each of said slots of said leg member and in said annular groove of said coupling means.

12. The golf club protecting system as in claim 8, wherein each of said head covers further comprises:

a tethering means for tethering said covering means to said foot portion, said tethering means being elongate and having a first and second end, said first end being fixedly coupled to a distal end of said foot portion and said second end being fixedly coupled to a distal portion of said covering means, said tethering means being flexible.

13. The golf club protecting system as in claim 8, each of said head covers further comprising:

a lifting means for lifting the heard of the golf club away from said foot portion, said lifting means being an elongate flexible member having a first end and a second end, said first end being fixedly coupled to an edge of said bottom side of said foot portion such that said elongate flexible member extends across said foot portion along a line orientated generally perpendicular to a line extending between distal and proximal ends of said foot portion, wherein said second end is lifted to pull the club head upward.

* * * * *